United States Patent [19]

Peterson

[11] Patent Number: 4,848,965

[45] Date of Patent: Jul. 18, 1989

[54] SCUBA WEIGHTS

[76] Inventor: Robert L. Peterson, 53 Sunnybrook Dr., N. Kingstown, R.I. 02852

[21] Appl. No.: 205,852

[22] Filed: Jun. 13, 1988

[51] Int. Cl.[4] ..... B63C 11/02

[52] U.S. Cl. ..... 405/186; 405/185

[58] Field of Search ..... 405/172, 186; D2/629, D2/630; D21/238, 196; 2/2.1 R, 312; 224/182, 195, 224, 225, 242, 251, 904; 114/315

[56] References Cited

U.S. PATENT DOCUMENTS

| | | | |
|---|---|---|---|
| 617,675 | 1/1899 | Crawford | 405/186 |
| 2,970,448 | 2/1961 | Julio | 405/186 |
| 3,192,723 | 7/1965 | Apperson | 405/186 |
| 3,220,197 | 11/1965 | Christiansen | 405/186 |
| 3,401,529 | 9/1968 | Fifield | 405/186 |
| 3,470,570 | 10/1969 | Christiansen | 405/186 X |
| 3,648,324 | 3/1972 | Stradella et al. | 405/186 X |
| 3,735,598 | 5/1973 | Oeland, Jr. | 405/186 |
| 3,808,824 | 5/1974 | Johnston et al. | 405/186 |
| 3,851,488 | 12/1974 | Schuler | 405/186 |
| 4,305,685 | 12/1981 | Rentfrow | 405/186 |

FOREIGN PATENT DOCUMENTS

| | | | |
|---|---|---|---|
| 1076353 | 2/1984 | U.S.S.R. | 405/186 |

*Primary Examiner*—Dennis L. Taylor
*Assistant Examiner*—Arlen L. Olsen
*Attorney, Agent, or Firm*—A. W. Breiner

[57] ABSTRACT

An improved scuba weight having a hex-nut locking device molded into the weight is described. The hex-nut locking device secures the weight to a diver's belt, but can be easily loosened, permitting the casting off of the weight, including in underwater operations, if desired.

4 Claims, 1 Drawing Sheet

SCUBA WEIGHTS

FIELD OF INVENTION

This invention relates to improved scuba weights. More particularly, the invention relates to improved scuba weights which are easily manufactured and which can be easily secured to a diver's belt and cast off when desired, including while under water.

BACKGROUND OF INVENTION

Scuba weights, including those which can be easily attached and detached to a belt of a diver, have been described in the prior art. Thus, U.S. Pat. No. 3,192,723 describes a diving weight wherein the weight has an upwardly opening groove of U-shaped configuration in a molded weight. The belt of a diver is fitted in the groove of the weight. The belt, because of the progressively increasing width of the opening from bottom to top, is retained by the combined wedging action of the U-shaped configured groove and the binding action of the belt. The configuration of the weight is relatively complex and, additionally, the securing action is dependent upon the shape of the belt and on the groove within the weight. Accordingly, wear on the belt or into the weight can adversely influence the securing and releasing features of the weight.

U.S. Pat. No. 3,648,324 describes a ballast diver's weight and belt characterized in that the weight has a quick-release spring action. The device is relatively complex and, due to the mechanism of the weight, is either necessarily manufactured from relatively expensive components or is subject to fouling as a result of the corrosive action of sea waters.

U.S. Pat. No. 2,970,448 discloses a diving ballast for support on a diver's belt. The diving ballast is made of a compressible and flexible material defining a block having a pair of slots provided therethrough and extending from opposite faces of the block. The slots are arranged as a continuation of each other but at different angles. One of the slots communicates with one of the surfaces of the block so that the block can be inserted on the belt of a diver. The other of the slots has a straight surface and an opposite surface bowed toward the straight surface of the other slot. The thickness of the second slot where the straight and curved surfaces are closed together at its narrowest point are slightly less than the thickness of the belt. This permits the attachment of the weight to the belt.

Other diver's weights are described in U.S. Pat. Nos. 3,808,824 and 4,305,685.

SUMMARY OF THE INVENTION

The present invention defines a diver's weight which is simple in construction, permitting convenient manufacture, having a secure locking means. The scuba weight of the invention comprises a weight of a molded material, such as lead or bronze, having an enclosed slot extending substantially through the center of the weight for receiving a diver's belt. A hex-nut locking device is molded into the weight, accessible from one face of the weight. A mated socket set-screw is screwed into the hex-nut to releasably secure the weight to a diver's belt. The hex-nut and setscrew, being divergently recessed into the face of the weight, can be easily located with a key by a diver, permitting rapid securing and releasing of the weight from the belt by the diver in order to control the buoyancy of the diver under existing diving conditions.

DESCRIPTION OF THE PREFERRED EMBODIMENT

Figure 1:
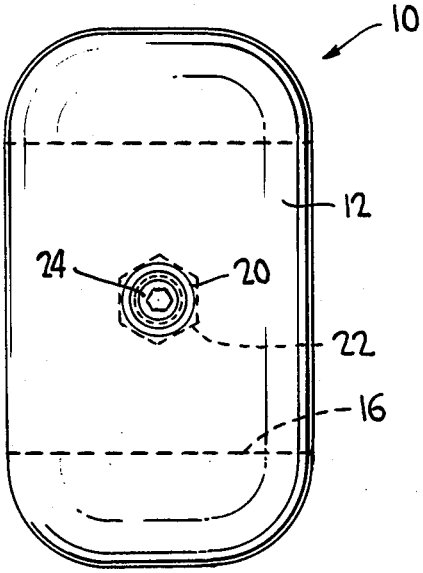
FIG. 1 is a front view of the scuba weight of the present invention.
Figure 2:
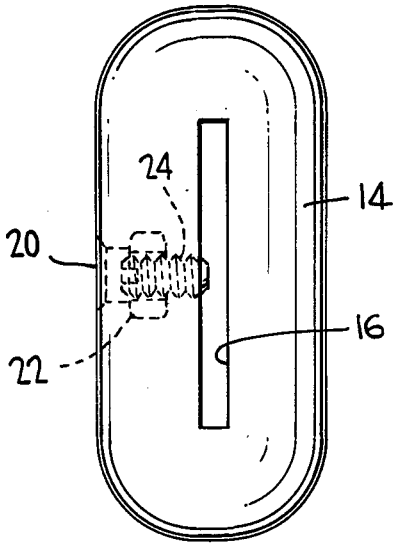
FIG. 2 is a cross-sectional side view of the weight of the present invention.

In the drawing, the scuba weight comprises an elongated weight member 10 having a face 12 on its major axis and a side 14 on its minor axis. An enclosed slot 16, substantially centrally located in the weight, extends through the minor axis. Slot 16 is sized to accommodate a diver's belt and, accordingly, can vary in width. One face at the major surface of the weight has an opening 20, preferably being divergent. At the base of the opening 20 is a steel hex-nut 22.

Figure 3:
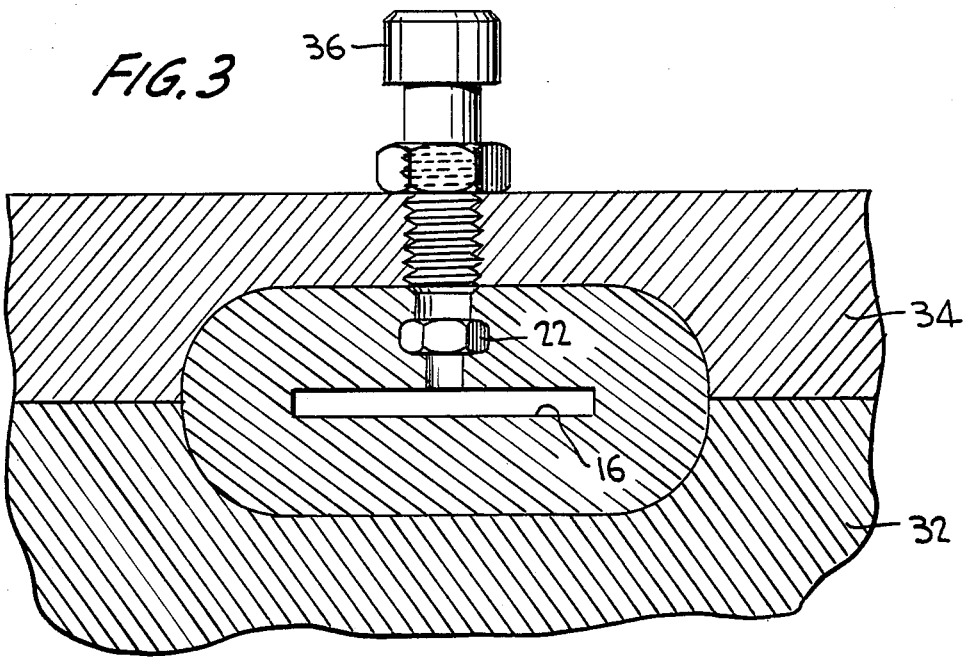
FIG. 3 is a mold containing the weight utilized to cast the scuba weight which incorporates the hex-nut locking device during casting.

The weight is manufactured in a split mold 30, as shown in FIG. 3, having a bottom half 32 and a top half 34. Preferably the mold is made of bronze metal. The mold permits the casting of a metal such as lead or other suitable heavy-weight metal such as bronze into the mold. During the casting a hex-nut of a force-resistant material such as steel is positioned in the mold. Accordingly, the metal of the weight is cast around the hex-nut. After the weight is cast of a suitable material such as lead, a cap screw 36 used to hold and position the hex-nut is removed to provide an opening having a threaded member at the base of the member extending through the major face of the weight into slot 16. A stainless steel socket set-screw 24 is then screwed into the stainless steel hex-nut. The socket set-screw can be screwed down into the hex-nut in order that the screw extends into the slot.

When a belt is positioned in the slot, the setscrew will frictionally engage the belt and secure the weight to the belt. Because of the divergent nature of the opening in the major face of the weight, the opening can be easily located by the diver, including under water, for releasing the weight if desired.

The scuba weight of the present invention can be molded in any configuration or weight. Preferably the weight, for a four-pound weight, will have a height across its major face of approximately 3½", and a width across the minor face of approximately 2". The slot for receiving the belt can have varying thicknesses, but generally will be approximately 1½" to 2". The width will be sized to conform to the width to receive a belt. The opening for the hex-nut is approximately centrally located within the weight. Preferably the scuba weight of the invention will have a weight of two pounds, three pounds, four pounds, five pounds, six pounds, eight pounds, and ten pounds. This will permit a diver to control his ballast under diving conditions.

Since the weight is constructed of a soft heavy material such as lead and bronze, it will not corrode including in saltwater. The hex-nut and socket set-screw, preferably constructed of stainless steel, again will not corrode under the adverse influences of sea water.

The scuba weight of the present invention provides a weight which can be molded relatively inexpensively and avoids the shortcomings of the prior art in that it can be securely attached to a diver's belt, but yet can be released under any conditions including while under water to modify the diver's ballast.

As will be apparent to one skilled in the art, various modifications can be made within the scope of the aforesaid description. Such modifications being within the ability of one skilled in the art form a part of the present invention and are embraced by the appended claims.

It is claimed:

1. A scuba weight for releasable attachment to a diver's belt comprising, in combination, a weight member having a major and minor axis; an enclosed, elongated slot substantially centrally located extending through the minor axis of said member constructed and arranged to receive a diver's belt; an opening substantially centrally located at one face on the major axis of said member extending through from said one face to intersect with said elongated slot, and a locking means positioned in said opening for releasably securing said weight to a diver's belt when said belt is contained in said slot.

2. The scuba weight of claim 1 wherein said opening in said one face is threaded and has therein a complementary set-screw member having a slotted opening for receiving a key member.

3. The scuba weight of claim 2 wherein said weight member is molded as one piece.

4. The scuba weight of claim 1 wherein said locking means comprises a hex-nut and a set-screw positioned in said hex-nut.

* * * * *